US006713168B2

(12) United States Patent
Liu et al.

(10) Patent No.: US 6,713,168 B2
(45) Date of Patent: Mar. 30, 2004

(54) FIRE RETARDANT WOOD COMPOSITE MATERIALS

(75) Inventors: Feipeng Liu, Statham, GA (US); Nian-hua Ou, Watkinsville, GA (US)

(73) Assignee: J.M. Huber Corporation, Edison, NJ (US)

( * ) Notice: Subject to any disclaimer, the term of this patent is extended or adjusted under 35 U.S.C. 154(b) by 149 days.

(21) Appl. No.: 09/904,126

(22) Filed: Jul. 12, 2001

(65) Prior Publication Data

US 2003/0064230 A1 Apr. 3, 2003

(51) Int. Cl.[7] ..... D21J 1/00

(52) U.S. Cl. ..... 428/292.4; 428/297.4; 428/298.1; 428/537.1; 524/13; 524/14; 524/417

(58) Field of Search ..... 428/532, 292.4, 428/297.4, 298.1, 107; 524/13, 14, 417; 525/410, 390, 414

(56) References Cited

U.S. PATENT DOCUMENTS

| | | | | |
|---|---|---|---|---|
| 4,014,839 A | | 3/1977 | Kraft et al. | |
| 4,182,794 A | | 1/1980 | Smith et al. | |
| 4,226,907 A | | 10/1980 | Sienkowski et al. | |
| 4,383,858 A | | 5/1983 | Wagner | |
| 4,828,643 A | * | 5/1989 | Newman et al. | 156/328 |
| 5,143,989 A | | 9/1992 | Lo et al. | |
| 5,281,486 A | | 1/1994 | Lo et al. | |
| 5,432,247 A | | 7/1995 | Lo et al. | |
| 5,880,243 A | | 3/1999 | Park et al. | |
| 6,042,639 A | | 3/2000 | Valso et al. | |
| 6,084,008 A | | 7/2000 | Liu | |
| 6,235,349 B1 | | 5/2001 | Grantham et al. | |

FOREIGN PATENT DOCUMENTS

| | | | | |
|---|---|---|---|---|
| WO | WO98/56989 A1 | * | 12/1998 | D21H/17/72 |

* cited by examiner

*Primary Examiner*—James J. Seidleck
*Assistant Examiner*—Melanie Bissett
(74) *Attorney, Agent, or Firm*—Carlos Nieves; David Mitchell Goodrich

(57) ABSTRACT

The invention relates to a fire retardant oriented strand board composite material comprising a mixture of wood strands, at least one organophosphorus ester, at least one polymeric binder resin, and a wax. In a process embodiment of the present invention this mixture is consolidated under heat and pressure to form an oriented strand board composite panel, whereby during consolidation the organophosphorus ester chemically interacts with the polymeric binder to provide cross-linking between the binder and the organophosphorus ester.

9 Claims, No Drawings

FIRE RETARDANT WOOD COMPOSITE MATERIALS

FIELD OF THE INVENTION

This invention relates to fire retardant wood composite materials for use in the commercial and residential building industry. In particular, organophosphorus fire retardant chemicals are incorporated into wood composite materials to achieve a high level of fire retardancy, while maintaining the quality and strength of the wood composite.

BACKGROUND OF THE INVENTION

In the past, the forest product industry has continued to seek and develop cost-effective fire retardant chemicals for use in wood composite materials, such as particleboard, fiberboard, oriented strand boards, agricultural straw board and inorganic building materials such as gypsum boards. Typically, acceptable fire retarding performance is achieved by manufacturing and incorporating a fire retardant compound in the wood composite. Although processes for preparing fire retardants for wood composite materials are known, there is a continuing need for a more cost-effective, environmentally beneficial means to satisfy flame retardant specifications, while maintaining the quality and strength of the wood composite materials.

Prior attempts to incorporate fire retardant organic phosphate esters into wood composite materials have met with little success, primarily because reactions between the phosphate ester and isocyanate binder can be unpredictable and can lead to pre-curing and interfacial strength loss during composite manufacture. Furthermore, some phosphate esters are easily decomposed under the hot press conditions during the manufacture of wood composites. Finally, phosphate esters generally tend to leach out of the composite over time, thereby making these phosphate esters undesirable and environmentally unfriendly fire retardant additives.

BRIEF SUMMARY OF THE INVENTION

In one object of the present invention, the invention includes a fire retardant wood composite material comprising a polymeric binder, and characterized in that the material further comprises at least one organophosphorus ester.

A further object of the present invention is a process for preparing a fire retardant oriented strand board composite material. A first step in this process is coating wood strands or flakes with at least one polymeric binder, wax, and at least one organophosphorus ester and forming a mat of the coated wood strands or flakes. A further step in this process is compressing the mat under heat and pressure to form an oriented strand board composite panel, characterized in that upon compression the at least one organophosphorus ester forms cross-links between polymer chains of the at least one polymeric binder resin.

Preferably, the organophosphorus ester has the formula:

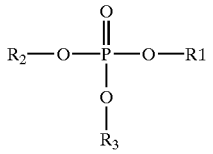

wherein $R_1$, $R_2$ and $R_3$ are either alkyl or aryl chains having hydroxyl, carboxylic or both hydroxyl and carboxylic functionality.

An object of the present invention is to provide a fire retardant wood composite material wherein an effective amount of organophosphorus fire retardant chemicals are incorporated into a wood composite material to form a wood composite material having a high level of fire retardancy.

Another object of the present invention is to provide wood composite materials comprising organophosphorus fire retardant additives, characterized in that the organophosphorus fire retardant additives cross-link with the polymeric binders and wood composite materials, thereby preventing leaching of the organophosphorus materials from the wood composite material. In addition, this cross-linking ameliorates the strength loss that typically accompanies the addition of functional additives like fire retardants, and also improves the dimensional stability and durability of the composite panel.

Accordingly the wood composite materials prepared according to the present invention have a limiting oxygen index of about 26 to about 40, an average thickness swelling in the range of about 7% to about 15%, and a fire spread rating of greater than about 25 and less than about 75.

Other objects, features and advantages will be readily apparent from the following detailed description of preferred embodiments thereof.

All parts, percentages and ratios used herein are expressed by weight unless otherwise specified. All documents cited herein are incorporated by reference. Concentrations of the polymer resins, waxes, fire retardants and other additives that are included in the wood composite materials of the present invention are calculated based on the weight of the over-dried wood flakes or strands.

DETAILED DESCRIPTION OF THE INVENTION

The present invention relates to a fire retardant wood composite materials that incorporate organic phosphorus esters as a fire retardant, as well as processes for their manufacture.

As used herein, "wood" is intended to mean a cellular structure, with the cell walls being composed of cellulose and hemicellulose fibers bonded together by lignin material, which functions as a type of polymer cement.

By "wood composite material" it is meant a composite material that comprises wood and one or more other additives, such as adhesives or waxes. Non-limiting examples of wood composite materials include oriented strand board ("OSB"), waferboard, chipboard, particle board, fiberboard, and plywood. As used herein, "flakes", "strands", and "wafers" are considered equivalent to one another and are used interchangeably.

Preferred wood composite materials utilized in this invention are derived from naturally occurring hard or soft woods, singularly or mixed, whether such wood is dried (having a moisture content of between 2 wt % and 12 wt %) or green (having a moisture content of between 30 wt % and 200 wt %). Preferably, the wood composite materials comprise dry wood parts having a moisture content of about 3 to 8 wt %. Typically, the raw wood starting materials, either virgin or reclaimed, are cut into strands, wafers or flakes of desired size and shape, which are well-known to one of ordinary skill in the art.

In the commercial manufacture of OSB panels, after the strands are cut they are dried to a moisture content of about 2 wt % to 5 wt % and then coated with a polymeric thermosetting binder resin and wax additive. Conventionally, the binder, wax and any other additives are applied to the wood materials by one or more spraying, blending or mixing techniques. One such technique is to spray the wax, resin and additives upon the wood strands as the strands are tumbled in a drum blender. Binder resin and various additives applied to the wood materials are referred to herein as a coating, even though the binder and additives may be in the form of small particles, such as atomized particles or solid particles, which do not form a continuous coating upon the wood material. Fire retardant chemicals are incorporated either before, during or after coating of the wood materials. These fire retardant chemicals may be sprayed on the wood materials, or in the alternative, premixed with the binder and/or wax additive. The blended mixture is formed into either a random mat or oriented multi-layered mats. In particular, the coated wood materials are spread on a conveyor belt in a series of alternating layers, where one layer will have the flakes oriented generally in line with the conveyor belt, and the succeeding layer oriented generally perpendicular to the belt, such that alternating layers have coated wood materials oriented in generally a perpendicular fashion. Subsequently, the formed mats will be pressed under a hot press machine which fuses and binds together the wood materials to form consolidated OSB panels of various thickness and size. Preferably, the panels of the invention are pressed for 2–10 minutes at a temperature of about 175° C. to about 240° C. The resulting composite panels will have a density in the range of about 40 to about 50 pcf (ASTM D1037-98) and a thickness of about 0.25 (¼") to about 1.5 (1½") inches.

Various polymeric resins, preferably thermosetting resins, may be employed as a binder for the wood flakes or strands. Preferred polymeric binders include isocyanate resin, urea-formaldehyde, phenol formaldehyde, melamine formaldehyde and the co-polymers thereof. More preferably, the polymeric binders are 4,4-diphenyl-methane diisocyanate ("MDI") and melamine urea formaldehyde ("MUF"). MDI has NCO— functional groups that can react with other organic functional groups to form polymer groups such as polyurea, —NCON—, and polyurethane, —NCOON—. MUF is a widely-used and cost effective polymeric binder, but is less water-resistant than MDI. Typically up to 50 wt % of the MUF binder is melamine, which is added to improve water-resistance. Suitable commercial MUF binders are the LS 2358 and LS 2250 products from the Dynea corporation.

Also suitable for use as polymeric binders are phenol-formaldehyde resins such as resol-type resins and novolac-type resins. These resins are produced by a reaction between phenol ($C_6H_6O$) and formaldehyde ($CH_2O$). In the case of resols, the synthesis of phenol and formaldehyde occurs in the presence of an alkaline catalyst, typically a sufficient amount of alkaline catalyst (e.g., sodium hydroxide or potassium hydroxide) is added to bring the pH of the resin to between 10 and 12. Higher pH environments do increase the cure rate of the polymer resins, however, these environments can also cause the organophosphorus esters (discussed in greater detail below) to decompose under hot press conditions.

Novolacs are produced similarly to resols, e.g., by reacting phenols and formaldehydes, but in the presence of an acid catalyst rather than an alkaline catalyst. Preferably a curing agent is added to increase the amount of cross-linking in the polymer, or alternatively, additional amounts of formaldehyde may be added either before or during the reaction between phenols and formaldehydes.

Resols and novolacs can also be distinguished by their molar ratio of formaldehyde to phenol: for resols the molar ratio of formaldehyde to phenol is larger than one, typically the ratio is between 1.6 and 2.2, while in novolacs, the same molar ratio is less than one, before adding hardener.

The binder level is preferably in the range of about 3 to about 20 wt %, more preferably about 3 to about 10 wt %.

A wax additive is commonly employed to enhance the resistance of the OSB panels to absorb moisture. Preferred waxes are slack wax or an emulsion wax. The wax loading level is preferably in the range of about 0.5 to about 2.5 wt %, based upon the oven-dried wood weight.

In accordance with a preferred embodiment of this invention, an organophosphorus ester is employed as a fire retardant chemical additive during the manufacture of OSB panels. The preferred organic phosphorous esters include a mono-, di- or tri-hydroxyl or carboxylic functional group which serves as a potential reaction site with the organic polymeric binder. In particular, preferred organic phosphate esters are oligomeric phosphonate, diethyl N,N bis[2-hydroxyethyl] aminomethylphosphonate and dimethyl methylphosphonate, respectively sold under the tradenames Fyrol® 51, Fryol® 6 and Fyrol® DMMP, by Akzo Nobel Chemical, Inc. Fyrol®51 and Fryol® 6 are advantageous because both have hydoxyl functional groups for reacting with MDI or MUF, while Fyrol® DMMP has the advantage of having a high phosphorous ester content and at the same time has a low viscosity that facilitates easy processing.

However, because Fryol® 51 has a high viscosity (approximately 30, 000 mPa.s, it is not suitable for application by spraying. However, it may be combined with other compounds having lower viscosity to prepare an organophosphorus fire retardant solution that is suitable for spraying. For example, Fryol® 51 may be mixed with Fryol® DMMP, which has a viscosity of 4 mPa.s, to form an organophosphorus solution. It is preferred that these compounds be mixed at a ratio of Fryol® 51: Fryol® DMMP of from about 1:1 to about 4:1.

The organophosphorus ester loading level is in the range of about 5 to about 30 wt %, preferably about 5 to about 20 wt %, more preferably about 5 to about 10 wt %, based upon the oven-dried wood weight.

Without intending to be limited by theory, it is believed that these organophosphorus esters not only function as fire retardants, but also act as cross-linking agents to increase the strength and durability performance of the resin. The hydroxyl and/or carboxyl functional groups of the organophosphorus ester compounds form primary bonds with the hydrocarbon backbone of the polymeric resin chains so as to join and rigidly connect adjacent chains. Thus, the cross-linking that accompanies the use of the organophosphorus esters results in final wood composite materials with increased strength and durability. Furthermore, the cross-linking reduces the likelihood that these organophosphorus esters will leach out from the composite panel.

The fire retardant organophosphorus ester chemicals may be incorporated into the wood strands that form an oriented strand board before, during or after the addition of the polymeric binder resin and wax additive material, but before they are heated and pressed. The order at which these compounds are applied to the wood flakes or strands to form the composite material is not essential to successfully practicing the present invention. There are two preferable orders of addition. In the first, wax is sprayed or applied onto the wood strands, and either simultaneous to the application of the wax or subsequent to the application of the wax, the organophosphorus ester fire retardant compound is sprayed or applied onto the wood strands, and lastly the polymeric resin is sprayed or applied onto the wood strands; in the second preferable order of addition, the wax is sprayed onto the wood strands, then the polymeric resin is sprayed or applied, and finally the organophosphorus ester fire retardant compound is added.

It is preferably to avoid premixing the fire retardant and polymeric resin because precuring and pre-gelling will occur with some mixtures of polymeric resins and fire retardants.

Spraying techniques and apparatuses for applying the wax, polymeric resin, and organophosphorus ester compound are well-known to those of ordinary skill in the art. A device such as a spray-gun may be used. However, certain organophosphorus ester compounds may be so viscous that it is impossible to apply them to wood strands by spray techniques, and so it is necessary to add viscosity modifiers to the organophosphorus ester compounds to lower their viscosity and make them suitable for spraying. As discussed above, FYROL® 51 can be mixed with FRYOL:DMMP to produce a solution having a viscosity suitable for spraying. Alternatively, FYROL® 51 can be mixed with other chemicals to reduce viscosity, for example, 2 wt % of SURFYNOL® SF 104 surfactant (manufactured by Air Products, Inc.), 2 wt % of propanol solution (ACS grade), and 10 wt % of acetone can be added to FYROL® 51, with the viscosity of the resulting organophosphorus ester solution being approximately 400 centipoise.

The invention will now be described with respect to the following specific, non-limiting examples.

EXAMPLE I

Square OSB panels measuring 50.8 cm on each side, having a target thickness of approximately 1.11 cm (approximately 7/16 inch), and a target density of 45 lbs/ft$^3$, were prepared by mixing pre-dried wood strands, 2 wt % slack wax, a polymeric binder and various fire retardant organophosphorus chemicals in the sequential order detailed below. The wood strands had a moisture content of about 2 wt % to 3 wt % and the materials were blended in a drum blender for approximately three minutes. Hot press conditions were as follows: (1) press closing time: 30 seconds, (2) press cooking time: 75 seconds, (3) de-gas time: 20 seconds, (4) press control temperature: 204° C. (400° F.).

For experimental runs 1–12, the strands were made from Yellow Southern pine. In the process of manufacture, the slack wax was first sprayed on the wood strands, followed by the fire retardant organophosphorus chemicals, followed by MDI. For experimental run 13, the slack wax was sprayed upon the wood strands followed by MDI, however no fire retardant chemical was added to the OSB panel. Accordingly, the panels of experimental run 13 served as a control group. In experimental run 14, MDI and Fyrol® 51 were pre-blended prior to spraying the mixture upon the wax coated wood strands, however because pre-gelling occurred shortly after pre-blending the MDI and Fyrol® 51 no panels were prepared under that design condition. For experimental run 15, slack wax was first sprayed on the wood strands, followed by the MDI, than fire retardant organophosphorus chemicals. Two OSB panels were prepared for each design condition.

The loading levels and types of fire retardant chemicals employed are listed below in Table 1.

TABLE 1

| Example No. | MDI wt % | wt % of Organophosphorus ester compounds | Organophosphorus ester compounds: |
|---|---|---|---|
| 1 | 5 | 5 | Fyrol ® 51 |
| 2 | 5 | 10 | Fyrol ® 51 |
| 3 | 8 | 5 | Fyrol ® 51 |
| 4 | 8 | 10 | Fyrol ® 51 |
| 5 | 5 | 5 | Fyrol ® 6 |
| 6 | 5 | 10 | Fyrol ® 6 |
| 7 | 8 | 5 | Fyrol ® 6 |
| 8 | 8 | 10 | Fyrol ® 6 |
| 9 | 5 | 5 | Fyrol ®-DMMP |
| 10 | 5 | 10 | Fyrol ®-DMMP |
| 11 | 8 | 5 | Fyrol ®-DMMP |
| 12 | 8 | 10 | Fyrol ®-DMMP |
| 13 | 5 | — | — |
| 14 | 5 | 5 | Fyrol ® 51 |
| 15 | 5 | 5 | Fyrol ® 51 |

In each of example nos. 1–15, the wt % of organophosphorus ester compound and polymeric resin compound is based on the oven-dried weight of the wood flakes and strands.

The OSB samples were subsequently cut into specific sizes and the following physical properties tested according to the procedure disclosed in ASTM D1037-98:

(1) Modulus of elasticity (MOE)

(2) Modulus of rupture (MOR)

(3) Internal Bonding (IB)

(4) 24 Hour Thickness Swelling (TS)

(5) 24 Hour Water Absorption (WA)

(6) Density of the tested panels

Although there is no single standard test to determine fire resistance of various construction materials, flame spread rating (also known as the "flame spread index") made in accordance with ASTM D-3806, have acquired common acceptance by various regulatory agencies. Individual Class Ratings represent a particular range of flame spread ratings as illustrated below.

| Flame Spread Rating | Class Rating |
|---|---|
| 0–25 | A |
| 25–75 | B |
| >75 | C |

In many states and municipalities it is required that construction materials for use in commercial or public buildings have a class rating of 'A'. 'C' class materials are more commonly used in residential applications.

Accordingly, the fire retardant properties for each of the experimental OSB panels prepared in experiment nos. 1–15 were determined by calculating the flame spread rating (also referred to as flame spread index) using a 2-foot tunnel-testing machine as directed by ASTM D-3806.

In addition, fire retardancy was measured by ASTM D-2863 to determine the limiting oxygen index (LOI). Essentially, the oxygen index test determines the amount of oxygen in a closed atmosphere which is required to support the combustion of an OSB panel. In brief, a specimen of a given composition is placed in a glass chimney in which a measured oxygen/nitrogen mixture flows upwardly. The specimen is ignited by means of a pilot flame and the burning behavior is observed. If the sample burns too rapidly, a new specimen of the same composition is tested at a lower oxygen concentration. If the sample does not burn within the prescribed limits, another new specimen of the same composition is tested at a higher oxygen concentration. This procedure is used to determine the lowest oxygen level at which the prescribed limits of the test are achieved which is defined as the LOI for that composition. The higher the LOI, the more flame resistant the composition.

Finally, cone calorimeter testing was used in accordance with ASTM E-1354-94 to determine the peak heat release rate (PHRR), ignition time (IT), and smoke extinguishing area (SEA).

The results of the above tests for each of the experimental OSB panels prepared is listed in Table 2, below. The control OSB panel is prepared by applying the mixture of Example No. 13 (which contains no organophosphorus ester fire retardant additive) to an OSB panel. This control OSB panel demonstrated an unfavorably low LOI of 26.89, and a very high FSI of 120. Conversely, the samples containing the fire retardant organophosphorus ester demonstrated superior fire retardant characteristics as compared to the control. Specifically, comparing the OSB panel of Example No. 13 (no organophosphorus ester applied) with the OSB panel of Example No. 15 (containing 5 wt % organophosphorus ester) shows that when an OSB panel contains an amount of organophosphorus ester, the FSI decreases by nearly 50% (and the corresponding ASTM E-84 fire safety class rating falls from a C rating to a B rating). Additionally, the LOI increases by approximately 27% when an organophosphorus ester is added to the OSB panel. Furthermore, the OSB panel of Example No. 15 has excellent strength properties, with a bonding strength of 115 psi.

While the density of each of the OSB panels varied in each of the examples, such variation is well within the range of densities that would have been expected by a person of ordinary skill in the art.

This data surprisingly demonstrates that preparing a wood composite material that includes wood strands, organophosphorus ester compounds and polymer binder resins results in a material that has excellent fire retardant performance.

TABLE 2

| | Physical Property Testing (ASTM E-1037-98) | | | | | | Cone Calorimeter Testing (ASTM E-1354-94) | | | | | |
|---|---|---|---|---|---|---|---|---|---|---|---|---|
| Example No. | Density (pcf) | MOE (psi) × $10^3$ | MOR (psi) | IB (psi) | TS % % | WA % % | PHRR $KW/m^2$ | IT (second) | 60 SEA ($m^2$/kg) | 60 ML (g/s*$m^2$) | LOI % | FSI |
| 1 | 41.5 | 417 | 4215 | 43.1 | 7.90 | 20.9 | 237.9 | 21.1 | 134.8 | 17.78 | 35.23 | 75.6 |
| 2 | 44.1 | 500 | 4042 | 44.0 | 7.4 | 18.1 | 208.3 | 14.8 | 132.4 | 16.77 | 37.32 | 67.8 |
| 3 | 43.9 | 474 | 4598 | 46.5 | 6.9 | 17.1 | 227.3 | 17.9 | 142.6 | 16.74 | 38.14 | 62.6 |
| 4 | 45.2 | 505 | 4184 | 56.4 | 7.2 | 15.0 | 236.8 | 16.5 | 136.0 | 17.20 | 39.96 | 65.2 |
| 5 | 48.1 | 720 | 6272 | 136 | 9.1 | 15.4 | 264.3 | 15.3 | 113.0 | 17.52 | 32.33 | 80.8 |
| 6 | 45.3 | 565 | 4400 | 44.6 | 18 | 27.3 | 246.2 | 12.3 | 132.8 | 17.67 | 34.13 | 93.8 |
| 7 | 47.1 | 568 | 5080 | 191 | 7.8 | 13.9 | 242.0 | 14.7 | 128.8 | 16.63 | 34.64 | 80.8 |
| 8 | 43.6 | 607 | 5230 | 120 | 11 | 15.3 | 258.8 | 8.3 | 137.4 | 17.72 | 34.75 | 93.8 |
| 9 | 42.7 | 631 | 5350 | 104 | 9.5 | 15.3 | 223.2 | 20.0 | 212.4 | 16.13 | 36.38 | 80.8 |
| 10 | 44.6 | 477 | 3170 | 32 | 21 | 29.9 | 252.8 | 17.6 | 207.2 | 17.15 | 37.4 | 73.0 |
| 11 | 41.7 | 715 | 6500 | 109 | 12 | 17.3 | 220.1 | 22.0 | 176.7 | 16.57 | 36 | 86.0 |
| 12 | 47.6 | 680 | 5448 | 143 | 8.8 | 17.9 | 210.7 | 19.7 | 185.8 | 15.47 | 39.67 | 65.2 |
| 13 | 52.0 | 694 | 6160 | 161 | 9.3 | 14.4 | 291.3 | 14.7 | 114.8 | 18.66 | 26.89 | 120 |
| 15 | 49.4 | 562 | 4800 | 115 | 7.0 | 13.9 | 219.7 | 14.4 | 132.4 | 15.94 | 34.2 | 65.2 |

In the table above "60 MLR" is the average mass loss rate at the first 60 second after the sample ignites and "60 SEA" is the average special extinguished area measured at the first 60 second after the sample ignites.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A wood composite material that is an oriented strand board comprising:

(i) an organophosphorus ester compound, (ii) a polymer binder resin, and (iii) about 0.5 wt % to about 2.5 wt % wax, wherein said composite material achieves a limiting oxygen index in the range of about 26 to about 40, an average thickness swelling in the range of about 7% to about 15%, and said composite material has a fire spread rating of greater than about 25 and less than about 75.

2. The fire retardant oriented strand board composite material according to claim 1, wherein the organophosphorus ester has the formula:

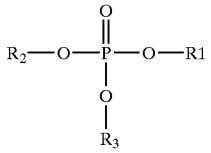

and $R_1$, $R_2$ and $R_3$ are independently either alkyl or aryl chains having hydroxyl, carboxylic or both hydroxyl and carboxylic functionality.

3. The fire retardant oriented strand board composite material according to claim 1 wherein the at least one organophosphorus ester is at least one ester selected from the group consisting of diethyl-N, N-bis(2-hydroxyethyl) aminomethyl phosphate; dimethyl methyl phosphate; diethyl-N, N-bis(2-hydroxyethyl) aminoethyl phosphonate; dimethyl-N, N-bis(2-hydroxyethyl) aminomethyl phosphonate;

dipropyl-N,N-bis(3-hydroxypropyl) aminoethyl phosphonate; and dimethyl-N, N-bis(4-hydroxybutyl) aminomethyl phosphonate.

4. The fire retardant oriented strand board composite material according to claim 1, wherein the organophosphorus ester is at least one ester selected from the group consisting of diethyl-N,N-bis(2-hydroxyethyl) aminomethyl phosphate and dimethyl methyl phosphate.

5. The fire retardant oriented strand board composite material according to claim 1 comprising from about 5 wt % to about 30 wt % of the organophosphorus ester compound.

6. The fire retardant oriented strand board composite material according to claim 2 wherein said polymeric binder is selected from the group consisting of isocyanates, phenol-formaldehydes, and melamine urea formaldehyde.

7. The fire retardant oriented strand board composite material according to claim 1 wherein the composite material comprises about 5 to about 30 wt % of the organophosphorus ester compound and about 3 to about 20 wt % of the polymeric binder.

8. The fire retardant oriented strand board composite material according to claim 1 wherein the composite material comprises about 5 to about 10 wt % of the organophosphorus ester and about 3 to about 10 wt % of the polymeric binder.

9. The fire retardant oriented strand board composite material according to claim 1, wherein the at least one organophosphorus ester forms cross-links between polymer chains of the at least one polymeric binder resin.

* * * * *